United States Patent [19]

Chlipalski

[11] 4,040,235

[45] Aug. 9, 1977

[54] APPARATUS FOR HANDLING LIQUID FILLED FLEXIBLE POUCHES

[76] Inventor: Adam Chlipalski, 55th Avenue, Lachine, Quebec, Canada

[21] Appl. No.: 706,604

[22] Filed: July 19, 1976

[51] Int. Cl.[2] ..... B65B 57/20; B65B 43/34

[52] U.S. Cl. ..... 53/59 R; 53/62; 53/159; 53/187; 53/261

[58] Field of Search ..... 53/59 R, 62, 159, 164, 53/260, 261, 187, 188

[56] References Cited

U.S. PATENT DOCUMENTS

| | | | |
|---|---|---|---|
| 2,753,097 | 7/1956 | Kindseth et al. | 53/188 |
| 3,050,918 | 8/1962 | Helm et al. | 53/188 X |
| 3,603,646 | 9/1971 | Leoff | 302/29 |
| 3,778,972 | 12/1973 | Chlipalski | 53/159 |

*Primary Examiner*—Travis S. McGehee
*Attorney, Agent, or Firm*—Diller, Brown, Ramik & Wight

[57] ABSTRACT

An improved apparatus for packaging a plurality of flexible liquid filled pouches in an outer flexible container.

Known similar machines have been limited in their speed of operation, such that production from such machines has not been as high as desired. To increase the speed of operation of the apparatus, it is proposed to utilize a feed conveyor incorporating a fluid-actuated clutch assembly which engages and disengages one of the conveyor pulleys from the conveyor belt. Operation of the clutch permits instantaneous operation of the feed conveyor assembly. Further, during high speed operation of the prior machines, flexible pouches tend to somersault when leaving the conveyor belt from the discharge end thereof. To prevent this somersaulting effect, it is proposed to utilize a pivotable barrier adjacent the output end of the feed conveyor. By utilizing the barrier, alignment of flexible pouches within the cradle assembly is achieved, even during high speed operation of the packaging apparatus.

15 Claims, 5 Drawing Figures

APPARATUS FOR HANDLING LIQUID FILLED FLEXIBLE POUCHES

BACKGROUND OF THE INVENTION

1. Field of the Invention

The present invention relates to improvements in an apparatus for packaging a plurality of flexible liquid filled pouches in an outer flexible container.

2. Description of the Prior Art

In U.S. Pat. No. 3,778,972, the present Applicant disclosed a machine for packaging sealed polyethylene pouches or bags in a flexible outer container. A number of drawbacks, however, have been encountered in practice in the operation of this machine.

One such problem is the limited speed at which the machine may be operated. As a result, production obtainable from the machine has not been as high as desired. In order to increase the speed of operation of the packaging apparatus, it is proposed to utilize a feed conveyor incorporating a fluid-actuated clutch assembly which engages and disengages one of the conveyor pulleys from a conveyor belt. Operation of the clutch permits instantaneous operation of the feed conveyor assembly which was unavailable in Applicant's previous packaging apparatus.

In Applicant's prior packaging apparatus, it has also been found that, during high speed operation thereof, flexible pouches tend to somersault, thereby impeding alignment of pouches within a cradle assembly. To prevent this somersaulting effect, it is now proposed to utilize a pivotable barrier adjacent the output end of the feed conveyor. By utilizing the barrier, alignment of flexible pouches within the cradle assembly is achieved, even during high speed operation of the packaging apparatus.

A further limitation on high speed operation of Applicant's previous flexible pouch packaging unit has been the problem encountered in removing aligned flexible pouches from the cradle after opening of the retractable bottom wall situated at the bottom of the cradle. In particular, the flexibility of the pouches results in a squeezing action occurring between the pouches and adjacent walls of the cradle, such that the pouches tend to stick to the walls of the cradle after the bottom wall is opened. It is proposed to prevent frictional engagement between the walls of the cradle and the adjacent pouches by forming an air film adjacent the surfaces of the walls, whereby engagement of adjacent pouches with the respective walls is prevented. In this way, flexible pouches are instantaneously released from the cradle upon actuation of the bottom wall.

In Applicant's previous machine, gripping of the flexible outer container during filling thereof with the flexible pouches was achieved by frictional engagement of outer surfaces of a pair of scoop-shaped jaws with adjacent portions of an interior surface of the outer flexible container. However, it has been found that this frictional engagement is insufficient to retain the outer flexible container in position during the filling thereof. As a result, it is proposed to provide a gripping arrangement in order to retain the outer flexible container during filling thereof with flexible pouches.

Applicant's prior apparatus for supplying a plurality of liquid filled flexible pouches into an outer flexible bag includes means for advancing and feeding the plurality of flexible pouches one by one. The apparatus also includes a flexible pouch receiving cradle assembly having at least one support wall and a retractable bottom wall. Means are provided for pivoting the cradle assembly between a first position whereby said support wall is inclined from the vertical below the angle of rest of said flexible pouches and adapted to receive a plurality of pouches fed from the advancing means stacked in side-by-side relation in the cradle assembly and a second position wherein said support wall is above the angle of rest of said pouches. Means are adapted to retract said bottom wall when the cradle assembly is in said second position. Means below and adjacent said bottom wall when said cradle assembly is in said second position are provided for opening and locating an outer flexible bag for receiving the pouches as the pouches are dropped simultaneously from the cradle.

SUMMARY OF THE INVENTION

According to one embodiment of the present invention, the improved apparatus has an advancing and feeding means including a conveyor belt supported by at least two conveyor belt support structures. A clutch arrangement is operatively connected to one of the belt support structures and source of power is operatively connected to another of the support structures. A clutch arrangement is adapted to move its respective support structure between a first position wherein the at least two support structures permit movement of the conveyor belt and a second position wherein movement of the conveyor belt is prevented. The support structure connected to the source of power is in motion before the clutch arrangement is advanced into the first position, whereby immediate delivery of pouches by means of the conveyor belt is obtained upon actuation of the clutch arrangement to the first position.

According to a further improvement of the present apparatus, means provide compressed gas to a surface of the support wall, the compressed gas urging the adjacent flexible pouch away from the surface of the support wall when the cradle assembly is in its second position, thereby increasing the rate of discharge of the flexible pouches from the cradle assembly upon retraction of the bottom wall thereof.

According to a further improvement of the apparatus, opening and locating means for opening and locating an outer flexible bag include spaced-apart jaw assemblies to fully open the outer bag while pouches are being dropped from the cradle assembly. Each jaw assembly includes a movably mounted gripping structure situated adjacent a respective scoop-shaped jaw, the gripping structure including a resilient gripping portion which engages a portion of the outer bag upon opening of the scoop-shaped jaws, each gripping portion cooperating with the adjacent scoop-shaped jaw to releasably retain the outer bag during filling thereof with the flexible pouches.

According to a further improvement of the present invention, the advancing and feeding means includes a conveyor belt and an improved stabilizing means, the improved stabiliziing means being situated adjacent a location where the flexible pouches are fed from the conveyor belt to the cradle assembly. The improved stabilizing means comprises a roller located above a path of travel of the flexible pouches along the conveyor belt, the roller adapted to engage each flexible pouch so as to limit somersaulting of the pouch upon being discharged from the conveyor belt. The improved stabilizing means also includes a pivotably mounted barrier, the barrier adapted to likewise engage each flexible pouch at a location where the pouch is being discharged from the conveyor belt, after engagement by the roller, the barrier adapted to direct each pouch into parallel alignment within the cradle assembly.

BRIEF DESCRIPTION OF THE DRAWINGS

In drawings which illustrates one embodiment of the proposed invention.

DESCRIPTION OF PREFERRED EMBODIMENTS

Figure 1:
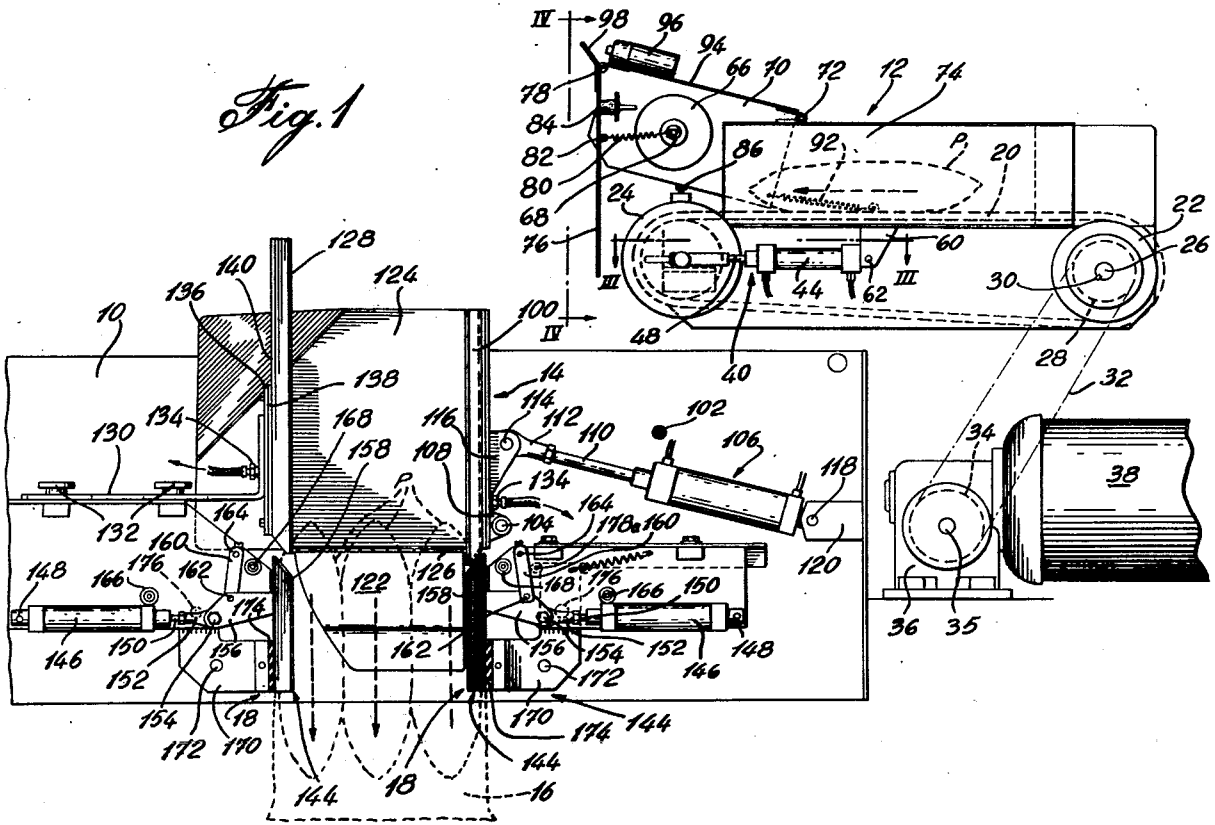
FIG. 1 is a side elevation of the improved packaging apparatus according to the present operation, illustrating the filling of the flexible outer container.

As best seen in FIG. 1, the improved packaging apparatus according to the present invention comprises a frame 10 which is adjustably supported by a stand, not shown in the drawings. A conveyor unit 12 is adapted to feed pouches P which are in alignment on the conveyor unit to a cradle assembly 14, from which the pouches P are permitted to drop into an opened flexible outer container or bag 16, shown in phantom in FIG. 1, the container or bag 16 being held by a bag opening assembly indicated generally by reference numeral 18. The flexible outer container 16 containing the pouches P is allowed to drop onto a conveying table, from which the filled outer container is directed to a sealing unit. Since the present invention is directed to an improved apparatus for placing pouches P in the outer container 16, details of the operation of the machine subsequent to the filling of the outer container are omitted from the present disclosure.

Referring to FIGS. 1 to 4, the conveyor unit 12 includes a conveyor belt 20 which is supported by a pair of pulleys 22 and 24. Pulley 22 is rotatably mounted on a shaft 26, the latter supporting a sprocket 28 which is secured thereto by means of key 30. A chain 32 extends about sprocket 28 and is driven by a further sprocket 34 mounted on the output shaft 35 of a speed reducer 36. The input shaft to the speed reducer 36 is driven by an electric motor 38.

Figure 3:
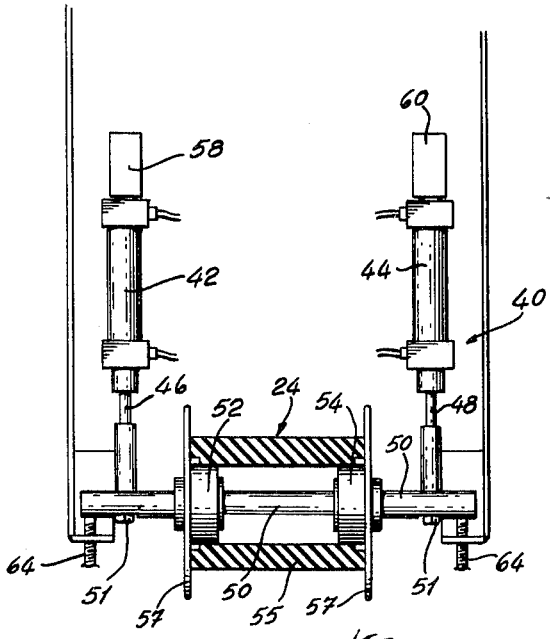
FIG. 3 is a horizontal section taken along the line III—III of FIG. 1.
Figure 4:
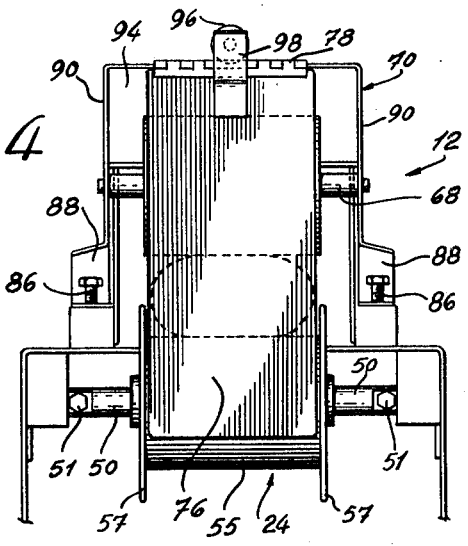
FIG. 4 is a front view taken in the direction of arrows IV—IV of FIG. 1.

Movement of conveyor belt 20 is achieved by frictional engagement of the belt with pulley 22. During this time, pouches P are fed by the conveyor unit 12 to the cradle assembly 14. In order to minimize the time for actuating the conveyor belt 20, a clutch assembly 40 associated with pulley 24 is utilized, the details of which are best seen in FIG. 3. The clutch assembly 40 causes engagement or disengagement of the pulley 24 with the conveyor belt 20. In particular, clutch assembly 40 includes a pair of spaced-apart double-acting fluid cylinders 42 and 44 having respective piston rods 46 and 48. The rods 46 and 48 are respectively connected to shaft 50, adjacent opposite ends thereof, by means of bolts 51. As a result, shaft 50 is prevented from rotation, while pulley 24 is rotatably mounted thereon. Pulley 24 includes a collar 55 which is supported away from non-rotatable shaft 50 by means of bearings 52 and 54 which are mounted on the shaft whereby collar 55 is rotatable with respect to the stationary shaft. A pair of annular end members 57 are rigidly secured to opposite ends of the collar in order to restrict lateral movement of conveyor belt 20 over pulley 24.

Each of the fluid cylinders 42 and 44 is respectively provided with a pair of connectors for connecting the cylinders to a suitable fluid supply for actuating the cylinders. Each of cylinders 42 and 44 is pivotally connected to a respective mounting bracket 58 and 60 by means of a pin 62. Actuation of fluid cylinders 42 and 44 results in movement of shaft 50 and pulley assembly 24 either towards or away from shaft 26 and pulley 22. In this way, tightening or loosening of the conveyor belt 20 supported by the pulleys 22 and 24 is achieved. To minimize time in initiating movement of the conveyor belt and delivery of pouches to the cradle assembly 14, pulley 22 is continuously rotated by means of motor 38, such that actuation of fluid cylinders 42 and 44 in order to separate the pulleys 22 and 24 results in tightening of conveyor belt 20, thereby providing instantaneous movement of the conveyor belt. Forward movement of the shaft 50 by means of the fluid cylinders is limited by utilizing a pair of abutment members 64 situated adjacent opposite ends of shaft 50.

In order to limit the somersaulting of pouches leaving the conveyor belt 20, a rotatably mounted roller 66 is supported by an axle 68 within a housing 70. The housing 70 is pivotally mounted at the upper and rear corner thereof by means of a hinge and pin arrangement 72 whereby the housing is pivotally secured to support structure 74. The upper front end of the housing 70 pivotally supports an upper end of a pivotably mounted barrier 76, the barrier 76 being connected to the housing 70 by means of a hinge and pin arrangement 78. The barrier 76 is engaged by means of one end of each of a pair of springs 80 at a location 82 partway along the height of the barrier 76. An opposite end of each spring 80 is secured to the axle 68. A stop member 84 limits pivotable movement of the barrier 76 about hinge and pin arrangement 78 due to the force of the springs 80. A pair of stop or abutment members 86 limit pivotal movement of the housing 70 about the hinge and pin arrangement 72 by engaging respective flanges 88 which extend outwardly from the lowermost edges of the side walls 90 of the housing 70.

A force is maintained between roller 66 and conveyor belt 20 by means of springs 92 which engage the lower and rearmost corners of the side walls 90 of the housing 70. In this way, housing 70 is biased in a counter-clockwise direction about the hinge and pin construction 72. Further, the top wall 94 of the housing 70 supports a counter 96 adjacent hinge and pin construction 78, the counter 96 adapted to be engaged by an actuator arm 98 which is rigidly secured to the top end of the barrier 76. Upon pivoting of the barrier 76 about hinge arrangement 78, actuator arm 98 is brought into engagement with an actuating button on the counter 96, thereby providing a count of the number of pouches P passing into the cradle assembly 14. The counter 96 can be interconnected with the actuating mechanism for the clutch assembly 40 whereby stoppage of the conveyor belt 20 is achieved upon delivery of a predetermined number of pouches P to the cradle assembly 14.

During operation, actuation of fluid cylinders 42 and 44 to separate pulleys 22 and 24 initiate operation of the conveyor belt 20. Pouches P situated on the conveyor belt 20 pass beneath roller 66 which applies a force to the pouch P passing between itself and adjacent belt 20, the spacing between the two being slightly less than the normal thickness of one of the pouches P. As a result, roller 66 rides over the top of the pouch P as each pouch P is advanced by conveyor belt 20, the effect thereof being such as to limit somersaulting of the pouches P as they leave conveyor belt 20. In order to further direct the travel of the pouches P leaving the conveyor belt, such that the longitudinal axes of the pouches are substantially parallel to the plane of a support wall 100 of the cradle assembly 14, the barrier 76 likewise engages the surface of each pouch P and applies a slight force to the end of each pouch, thereby further directing the travel of each pouch into the desired position within the cradle assembly 14.

Figure 2:
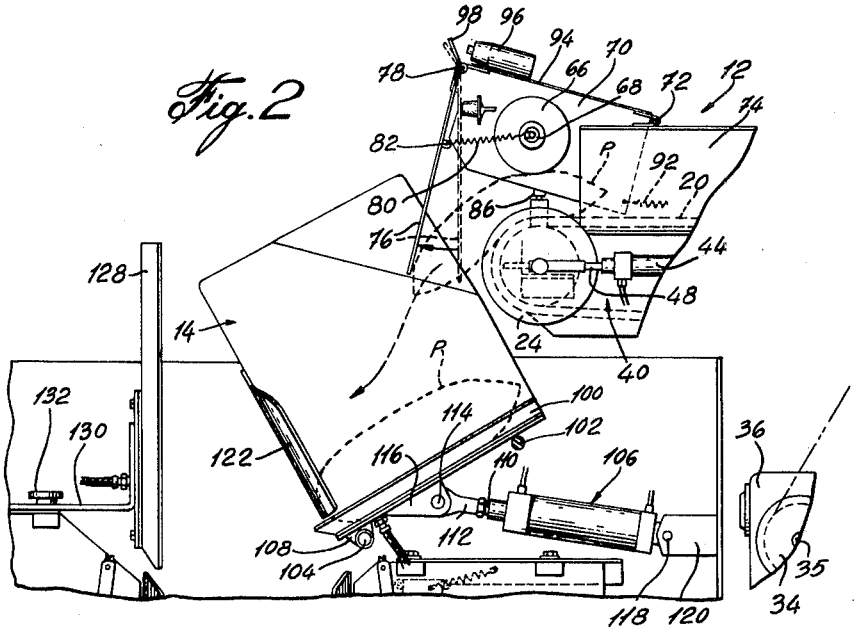
FIG. 2 is a side elevation of a portion of the improved apparatus according to FIG. 1 during filling of the cradle assembly.

The cradle assembly 14, when in its receiving position, as shown in FIG. 2 is such that its support wall 100 engages abutment member 102, the cradle assembly having been pivoted about its support shaft 104 by means of piston and cylinder arrangement 106. The cradle assembly 14 is supported from the support shaft 104 by means of a bracket 108 which is secured to support wall 100. Likewise, piston shaft 110 of piston and cylinder arrangement 106 is provided at its outer end with a female rod end connection 112. A pin 114 extending transversely between a pair of spaced-apart plates forming a bracket 116 engage an opening in the connection 112, the bracket 116 being secured to the support wall 100 of the cradle assembly 14. The opposite end of the piston and cylinder arrangement 106 is pivotally connected by means of a pin 118 to a stationary support bracket 120 whereby pivoting of the arrangement 106 about the pin 118 is obtainable. Actuation of the piston and cylinder arrangement 106 advances cradle assembly 14 from its receiving position, shown in FIG. 2 in which support wall 100 engages abutment member 102, to a delivery position, as illustrated in FIG. 1, wherein a longitudinal axis of the cradle assembly 14 is substantially vertical. In the delivery position, a retractable bottom wall 122 which is secured to a rear wall 124 by means of a hinge and pin assembly 126 is permitted to open, thereby allowing pouches within the cradle assembly 14 to fall from the cradle assembly 14. Operation of the bottom wall 122 by means of a cam and follower is achieved in a known manner and is not described for the purposes of the present invention.

In the delivery position, the support wall 100 is positioned opposite the stationary guide wall 128 which is spaced from support wall 100 a distance slightly greater than the combined width of the pouches P located within the cradle assembly 14. The spacing between walls 100 and 128 can be varied depending upon the desired number of pouches P to be packaged in the flexible outer bags 16 at one time. To achieve this, a support member 130 which supports guide wall 128 in position can be adjusted in a longitudinal direction and can be secured in the desired position by means of adjustment screws and knobs 132.

Figure 5:
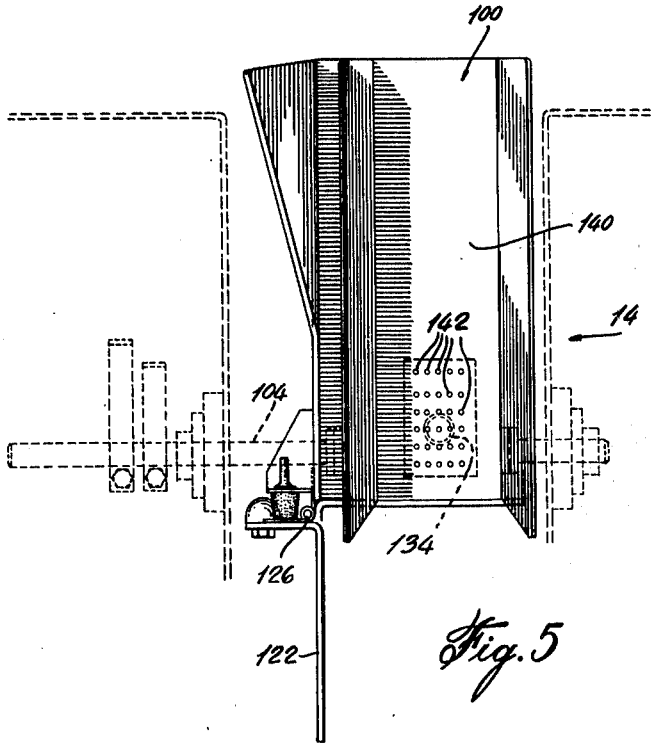
FIG. 5 is a front view of the support wall of the cradle assembly.

In order to facilitate removal of pouches P from the cradle assembly 14 upon opening of retractable bottom wall 122, compressed air is provided to the surfaces of support wall 100 and guide wall 128. To achieve this, compressed air is fed through tubing to the walls via connectors 134 mounted on the rear surface of each wall. Each wall comprises a rear plate 136, an intermediate spacer or gasket 138 which functions as a manifold, and a front plate 140. The spacer or gasket 138 includes a central opening which receives compressed air passing through the connector 134 in the rear plate 136. The front plate 140 includes a number of spaced passageways 142 located adjacent the opening in the gasket 138, as best seen in FIG. 5. The passageways 142 direct the flow of air from the opening in the gasket 138 to the outer surface of the front plate 140. The distribution of passsageways 142 is such as to provide an even distribution of compressed air over the surface of the front plate 140. The use of compressed air in this application has been found necessary due to the flexibility of the pouches P which otherwise adhere to support wall 100 or guide wall 128, even after retractable bottom wall 122 is opened. Indeed, even the use of TEFLON, a registered trade mark of E. I. du Pont & Co., on the walls has been found in the past not to provide a satisfactory solution to the problem.

In order to direct the pouches P into the flexible outer bag 16, a pair of scoop-like jaw assemblies 144, best seen in FIGS. 1 and 2, are utilized. Since each assembly 144 is of identical construction and operation, the reference numbers of identical components in each assembly are the same.

Each assembly 144 includes a piston and cylinder arrangement 146 which is pivotally secured at one end to a stationary support by means of a pin 148. The piston arm 150 is provided with a female rod end connection 152 which engages a bolt 154 such that the connection 152 is pivotable about the bolt 154. The bolt 154 extends between a pair of spacedapart plates 156, the plates being connected to the rear surface of a scoop-like jaw 158. A further arm 160 is pivotally connected at one end to a pin 162 extending between plates 156, an opposite end of arm 160 being pivotally connected by means of a further pin 164 to a stationary support. As a result, pin 164 and pin 148 provide the pivoting points for the assembly 144 relative to the stationary support. Each jaw assembly 144 also includes a pair of abutment members 166 and 168 which, in combination with the remaining components of each assembly, determine the path of travel of the scoop-like jaws 158.

The function of each scoop-like jaw 158 is to grasp an interior portion of the flexible outer bag 16 and open the bag in order to permit insertion of the pouches P. Further, the jaws 158 support the bag 16 in an upright position during filling with the pouches P. Since frictional engagement of the jaws 158 with the interior surface of the bag 16 has been found not to provide sufficient force to retain the bag in position during loading thereof with the pouches P, each jaw assembly 144 is provided with a respective L-shaped arm structure 170, the individual arm members of which are connected together by means of a spacer 172. The innermost end of each structure 170 supports a rubber pad 174, the rubber pad 174 adapted to cooperate with the outer surface of an adjacent jaw 158 in order to grasp and retain a portion of the flexible outer bag 16 in position during filling thereof. Each arm structure 170 is pivotally mounted about an axle 176 and pivoting of each structure 170 about the pivot point is limited by a pair of spaced-apart stop members 178. A spring is connected to each arm structure which biases the rubber pads 174 toward their respective scoop-like jaw 158.

In the filling position of the flexible outer container 16, as seen in FIG. 1, the jaws 158 are in substantially vertical positions with the arm structures 170 urging the rubber pads 174 against the outer surfaces of the jaws 158, with portions of the outer bag being supported between the rubber pads 174 and the adjacent surface of the jaws 158. After filling of the outer bag 16 is completed, piston and cylinder arrangement 146 is actuated and piston arms 150 are urged outwardly. As a result, each arm 160 pivots about its respective pin 164 until the arm engages abutment member 168. At this point, further extension of the piston rod 150 results in spaced-apart plates 156 pivoting about pin 162, whereby the jaw 158 is pivoted upwardly and inwardly. This position of the shovels permits the insertion of a further outer bag 16 while the cradle assembly 14 is being filled with further pouches P.

Prior to cradle assembly 14 discharging the pouches P, each piston and cylinder arrangement 146 is actuated, whereby plates 156 pivot about pin 162 until arm 160 pivots out of engagement with its abutment member 168. Simultaneously, piston and cylinder arrangements 146 pivot about their pivot pins 148 until they engage their respective abutment members 166. In this position, the piston and cylinder arrangements are in substantially horizontal positions, and the jaws 158 are in substantially vertical positions, such that further movement of the piston rods 150 results in lateral movement of the jaws 158 into engagement with the inner surface of the outer bag 16. At this point, the retractable bottom wall 122 is opened and the pouches P are permitted to fall into the flexible outer bag 16.

As the pouches P are delivered to the cradle assembly 14, the same are stacked side-by-side over the support wall 100, such that longitudinal axes of the pouches P are in parallel alignment with the support wall 100. During the filling of the cradle assembly 14, retractable bottom wall 122 remains closed. The guide wall 128 can be adjusted so that cradle assembly 14 can receive 2, 3 or even 4 pouches P, with the width of the trap door utilized being dependent upon the number of pouches P. The replacement of the bottom wall 122 in order to provide a retractable bottom wall of increased width, for example, can be achieved by disassembling hinge and pin assembly 126 and installing a retractable bottom wall with a greater width. As well, the position of the guide wall 128 can be extended in order to position wall 128 a sufficient distance from support wall 100 in order to provide sufficient space for the desired number of pouches P to be transferred by means of the cradle assembly 14.

As the cradle assembly 14 is being filled, air nozzles, not shown, are actuated in order to direct the flow of compressed air into an open end of an exposed outer bag, thereby assisting in the opening of the outer bag 16.

I claim:

1. An apparatus for supplying a plurality of liquid filled flexible pouches into an outer flexible bag, the apparatus including means for advancing and feeding the plurality of flexible pouches one by one; a flexible pouch receiving cradle assembly having at least one support wall and a retractable bottom wall; means pivoting the cradle assembly between a first position whereby said support wall is inclined from the vertical below the angle of rest of said flexible pouches and adapted to receive a plurality of pouches fed from the advancing means stacked in side-by-side relation in the cradle assembly and a second position wherein said support wall is above the angle of rest of said pouches, means adapted to retract said bottom wall when the cradle assembly is in said second position, means below and adjacent said bottom wall when said cradle is in said second position for opening and locating an outer flexible bag for receiving the pouches as the pouches are dropped simultaneously from the cradle assembly, the advancing and feeding means including a conveyor belt supported by at least two conveyor belt support structures; a clutch arrangement operatively connected to one of the belt support structures and a source of power operatively connected to another of the support structures, the clutch arrangement adapted to move its respective support structure between a first position wherein the at least two support structures permit movement of the conveyor belt and a second position wherein movement of the conveyor belt is prevented, the support structure connected to the source of power being in motion before the clutch arrangement is advanced into the first position whereby immediate delivery of pouches by means of the conveyor belt is obtained upon actuation of the clutch arrangement to the first position.

2. An apparatus according to claim 1, wherein the support structure operatively connected to the clutch arrangement comprises a non-rotatable shaft supporting a rotatably mounted pulley arrangement, the clutch arrangement comprising at least one actuator means operatively connected to the non-rotatable shaft, the actuator means advancing the pulley assembly into the first position upon the cradle assembly reaching its first position.

3. An apparatus according to claim 2, wherein the actuator means comprise a pair of fluid piston and cylinder arrangements, each piston and cylinder arrangement connected to a respective end of the non-rotatable shaft, the advancing and feeding means further including abutment members in order to limit movement of the non-rotatable shaft by means of the fluid piston and cylinder arrangements.

4. An apparatus according to claim 2, wherein the flexible pouch receiving cradle assembly has two walls.

5. An apparatus for supplying a plurality of liquid filled flexible pouches into an outer flexible bag, the apparatus including means for advancing and feeding the plurality of flexible pouches one by one; a flexible pouch receiving cradle assembly having at least one support wall and a retractable bottom wall; means pivoting the cradle assembly between a first position whereby said support end wall is inclined from the vertical below the angle of rest of said flexible pouches and adapted to receive a plurality of pouches fed from the advancing means stacked in side-by-side relation in the cradle assembly and a second position wherein said support wall is above the angle of rest of said pouches, means adapted to retract said bottom wall when the cradle assembly is in said second position, means below and adjacent said bottom wall when said cradle is in said second position for opening and locating an outer flexible bag for receiving the pouches as the pouches are dropped simultaneously from the cradle assembly, the advancing and feeding means including a conveyor belt and improved stabilizing means, the improved stabilizing means being situated adjacent a location where the flexible pouches are fed from the conveyor belt to the cradle assembly, the improved stabilizing means comprising a roller located above a path of travel of the flexible pouches along the conveyor belt, the roller adapted to engage each flexible pouch so as to limit somersaulting of the pouch upon being discharged from the conveyor belt, the improved stabilizing means also including a pivotably mounted barrier, the barrier adapted to likewise engage each flexible pouch at a location where the pouch is being discharged from the conveyor belt after, thereby directing each pouch into a desired position in the cradle assembly.

6. An apparatus according to claim 5, wherein the pivotably mounted barrier extends transversely to the path of travel of the pouches on the conveyor belt, the barrier also including biasing means which urge the barrier toward the conveyor belt adjacent the discharge end thereof, abutment means also engaging the barrier to limit pivotal movement of the barrier under the action of the biasing means towards the conveyor belt.

7. An apparatus according to claim 6, wherein counter means are operatively connected to the pivotably mounted barrier, the counter means adapted to be engaged by the barrier in response to each pouch engaging the barrier, the counter means operatively associated with the conveyor belt to stop movement thereof after reaching a predetermined count corresponding to a predetermined number of pouches.

8. An apparatus according to claim 6, wherein the flexible pouch receiving cradle assembly has two walls.

9. An apparatus for supplying a plurality of liquid filled flexible pouches into an outer flexible bag, the apparatus including means for advancing and feeding the plurality of flexible pouches one by one; a flexible pouch receiving cradle assembly having at least one support wall and a retractable botton wall; means pivoting the cradle assembly between a first position whereby said support wall is inclined from the vertical below the angle of rest of said flexible pouches and adapted to receive a plurality of pouches fed from the advancing means stacked in side-by-side relation in the cradle assembly and a second position wherein said support wall is above the angle of rest of said pouches, means adapted to retract said bottom wall when the cradle assembly is in said second position, means below and adjacent said bottom wall when said cradle is in said second position for opening and locating an outer flexible bag for receiving the pouches as the pouches are dropped simultaneously from the cradle assembly, means providing compressed gas to a surface of the support wall, the compressed gas urging the flexible pouches away from the surface of the support wall when the cradle assembly is in the second position, thereby increasing the rate of discharge of the flexible pouches from the cradle assembly upon retraction of the bottom wall thereof, the means providing compressed gas to the support wall includes a front plate having a plurality of spaced apart perforations therein, and a manifold means connected to the front plate, the manifold means adapted to direct compressed gas to the plurality of perforations in the front plate, the manifold means including an intermediate gasket having an opening therein, the opening being situated adjacent the plurality of perforations in the front plate, the manifold means also including a back plate; the front plate, intermediate gasket, and back plate being secured together; the back plate including a compressed gas connector therein adjacent the opening in the intermediate gasket, the connector adapted to direct compressed gas into the opening, and the perforations adapted to direct compressed gas from the opening in the intermediate gasket to the outer surface of the front wall.

10. An apparatus according to claim 9, wherein the flexible pouch cradle receiving assembly has two support walls.

11. An apparatus according to claim 10, wherein a guide wall is supported by the apparatus in a position substantially parallel to the support wall when the cradle assembly is in its second position, the guide wall being located at a distance from the support wall, the distance being substantially equal to the number of flexible pouches contained within the cradle assembly, the guide wall including a plurality of perforations therein and being provided with manifold means whereby compressed gas is directed through the plurality of perforations to an outer surface of the guide wall.

12. An apparatus for supplying a plurality of liquid filled flexible pouches into an outer flexible bag, the apparatus including means for advancing and feeding the plurality of flexible pouches one by one; a flexible pouch receiving cradle assembly having at least one support wall and a retractable bottom wall; means pivoting the cradle assembly between a first position whereby said support wall is inclined from the vertical below the angle of rest of said flexible pouches and adapted to receive a plurality of pouches fed from the advancing means stacked in side-by-side relation in the cradle assembly and a second position wherein said support wall is above the angle of rest of said pouches, means adapted to retract said bottom wall when the cradle assembly is in said second position, means below and adjacent said bottom wall when said cradle is in said second position for opening and locating an outer flexible bag for receiving the pouches as the pouches are dropped simultaneously from the assembly cradle, the opening and locating means, including spaced apart jaw assemblies to fully open the outer bag while pouches are being dropped from the cradle assembly, each jaw assembly including a movable mounted gripping structure situated adjacent a respective scoop-shaped jaw, the gripping structure including a resilient gripping portion which engages a portion of the outer bag upon opening of the scoop-shaped jaws, the gripping portion cooperating with the adjacent scoop-shaped jaw to releasably retain the outer bag during filling thereof with the flexible pouches, each scoop-like jaw having a piston and cylinder arrangement connected thereto, one end of each cyliner is pivotally mounted on a stationary frame portion of the apparatus, the piston is pivotally connected to a bracket mounted on a rear surface of the scoop-like jaw, a link member is also pivotally connected at one end thereof to the bracket mounted on the scoop-like jaw, the other end of the link member is pivotally connected to the stationary frame portion of the apparatus, each jaw assemby also includes a pair of first and second abutment members mounted on the stationary frame portion, the pivotally mounted piston and cylinder arrangements adapted to cooperate with the link members and the first abutment members to effect lateral movement of the jaws as the link members pivot about the stationary frame portion until the link members engage the second abutment members with further extension of the piston and cylinder arrangement pivotting the scoop-like jaws about the pivotal connection between the jaws and their respective link members, the lateral and pivotal movement of the scoop-like jaws during opening and closing thereof facilitating opening of the outer flexible bag during filling thereof, as well as removal of the outer flexible bag after filling with flexible pouches.

13. An apparatus according to claim 12, wherein the flexible pouch receiving cradle assembly has two wall

14. An apparatus according to claim 13, wherein the gripping structure includes a pair of pivotably mounted L-shaped arm structures, each arm structure including a gripping pad at the lower end thereof, the arm structures being biased by biasing means in a direction of the adjacent scoop-shaped jaw.

15. An apparatus according to claim 14, wherein each arm structure includes abutment members to limit pivotal movement about the pivot point thereof.

* * * * *